US006592081B2

(12) United States Patent
Yerge

(10) Patent No.: US 6,592,081 B2
(45) Date of Patent: Jul. 15, 2003

(54) ELECTRONIC CODE GENERATING CIRCUIT FOR USE IN RAILROAD SIGNALING SYSTEMS

(75) Inventor: Thomas W. Yerge, Dundalk, MD (US)

(73) Assignee: National Railroad Passenger Corporation, Washington, DC (US)

( * ) Notice: Subject to any disclaimer, the term of this patent is extended or adjusted under 35 U.S.C. 154(b) by 0 days.

(21) Appl. No.: 09/794,324

(22) Filed: Feb. 28, 2001

(65) Prior Publication Data

US 2002/0153456 A1 Oct. 24, 2002

(51) Int. Cl.[7] ..... B61L 21/00

(52) U.S. Cl. ..... 246/34 CT; 246/59; 246/62; 340/3.2; 340/310.01; 370/463

(58) Field of Search ..... 246/34 CT, 34 B, 246/47, 63 C, 59, 62, 180; 340/3.2, 3.21, 3.22, 3.23, 3.24, 310.01; 370/463, 419, 420, 424

(56) References Cited

U.S. PATENT DOCUMENTS 3,731,004 A * 5/1973 Cowpland et al. ..... 327/108
3,955,125 A * 5/1976 Butler et al. ..... 327/399
4,150,284 A * 4/1979 Trenkler et al. ..... 359/142
4,151,407 A * 4/1979 McBride et al. ..... 359/142
4,891,973 A * 1/1990 Bollweber et al. ..... 340/448
5,018,134 A * 5/1991 Kokubo et al. ..... 370/289
5,228,027 A * 7/1993 Yamaguchi ..... 370/431
5,263,669 A * 11/1993 Ehrlich ..... 246/180
5,470,034 A * 11/1995 Reeves ..... 246/122 R
5,711,497 A * 1/1998 Andrianos et al. ..... 246/167 R
5,838,249 A * 11/1998 Saito et al. ..... 340/3.21
5,905,758 A * 5/1999 Schweiter et al. ..... 359/135
5,939,896 A * 8/1999 Hedberg ..... 326/30

* cited by examiner

*Primary Examiner*—S. Joseph Morano
*Assistant Examiner*—Frantz F. Jules
(74) *Attorney, Agent, or Firm*—Lowe Hauptman Gilman & Berner, LLP

(57) ABSTRACT

An electronic code transmitter is disclosed for driving a number of code following relays of a railroad signaling system. The electronic code transmitter comprises a timing circuit and a driving circuit. The timing circuit generates, at a predetermined code rate, square wave pulses with an approximate 50/50 duty cycle. The driving circuit receives the square wave pulses and conducts, at the predetermined code rate, a power source to the code following relays. Where the timing circuit is a timer IC operating in an astable oscillator mode, the timer IC receives an isolated DC power from a DC-DC converter. A resistor is coupled in parallel with the code following relays if the code following relays present a sufficiently high impedance load to the electronic code transmitter. Thereby, the electronic code transmitter is capable to drive code following relays of any load impedance.

41 Claims, 7 Drawing Sheets

ELECTRONIC CODE GENERATING CIRCUIT FOR USE IN RAILROAD SIGNALING SYSTEMS

TECHNICAL FIELD

The present invention relates to electronic code generating circuits, and more particularly, to an electronic code transmitter for use in railroad signaling systems.

BACKGROUND OF THE INVENTION

Railroad signaling systems have long been incorporated in high speed railroad territories to transmit data to trains travelling along the tracks. The data can contain both information, such as indications of advance traffic conditions, and commands, such as speed control. When displayed to the train engineer, the data assists the train engineer to govern the train movements in accordance with the track condition ahead of the train.

The invention is especially suitable for use in those railroad signaling systems where the data, in the form of coded pulses, are transmitted along the tracks to the train. The coded pulses of certain types are detected by an onboard detection system which is located on the train locomotive, motor, or cab control car. The coded pulses are then decoded and display the appropriate cab signal to the train engineer. The cab signal is a miniature set of railroad signals which are presented inside the train engineer's compartment.

Coded pulses, which typically are of an on/off direct current energy type with low frequency, have been used in railroad signaling systems for some time. The coded pulses are characterized by two critical components: code rate and duty cycle.

The number of code rates used and the frequency of each code rate varies from system to system. Some systems may input six different code rates onto the rails. Other systems use up to twelve code rates. Currently, Amtrak employs five code rates of 50, 75, 120, 180 and 270 beats per minute which correspond to the frequencies of 0.83, 1.25, 2, 3, and 4.5 Hz, respectively. Each code rate displays its own unique cab signal, except the 50 code rate which is non vital. If the code rate is out of specification, the coded pulses will not be recognized and will be rejected by the train onboard detection system. This will result in the most restrictive cab signal to be displayed, and will cause train delays.

The same problems will arise if coded pulses are output with an inaccurate duty cycle. Duty cycle is understood as on-time percentage of a pulse. An illustration is depicted in FIG. 4. As shown in the bottom graph of FIG. 4, each pulse has a duration of T which consists of an on-time period $t_1$ and an off-time period $t_2$. The ratio of the on-time period $t_1$ and the duration T in percentage is the duty cycle of the pulse. For coded pulses are recognizable by the train's onboard detection system, the duty cycle should be 50% or near 50%. That means the on-time $t_1$ is desirably equal or approximate to the off-time $t_2$.

Even if the code rate and duty cycle are correct, the train onboard detection system may sometimes still not be able to detect the coded pulses if the waveform of the pulses is distorted. Though other waveforms are available, the square waveform as presented in the bottom graph of FIG. 4 is recommended for most railroad signaling systems.

To meet such strict requirements relating to the correctness of code rate and duty cycle, appropriate code generators are needed. Presently, Amtrak uses expensive mechanical code generators to drive a number of code following relays which are mostly of the electromechanical type. The code following relays repeat exactly the code rate dictated by the code generators. If the output of the code generator is incorrect, the coded pulses input onto the rails by the code following relays will also be incorrect, and will be rejected by the train onboard detection system. It has been observed that many mechanical code generators suffer with inaccurate output after long in-service years under severe weather conditions. These mechanical code generators have a high incidence of failure as well. The heavy load of a large growing number of code following relays to be driven is another reason that makes mechanical code generators unsuitable for use in the railroad signaling systems.

When the need arises to replace the mechanical code generators, electronic versions thereof have been introduced, but at unacceptably high cost.

SUMMARY OF THE INVENTION

An object of the invention is, therefore, to provide an effective and inexpensive electronic code transmitter for use in railroad signaling systems.

Another object of the invention is to provide such an electronic code transmitter which is capable of driving a sufficiently large number of code following relays for a long time under harsh environmental conditions, yet still capable of precisely producing desired coded pulses.

A further object of the invention is to provide such an electronic code transmitter to be a direct replacement for existing mechanical code generators which become obsolete.

Yet another object of the invention is to provide such an electronic code transmitter of universal circuit design which allows for easy regulation and visual indication of the output code rate.

The aforementioned and other features are accomplished, according to an aspect of the present invention, by an electronic code transmitter for driving a number of low impedance code following relays of a railroad signaling system. The electronic code transmitter comprises a timing circuit and a driving circuit coupled to the timing circuit. The timing circuit generates, at a predetermined code rate, square wave pulses with an approximate 50/50 duty cycle; and feeds the square wave pulses into the driving circuit. The driving circuit, upon receiving the square wave pulses, conducts, at the predetermined code rate, a power source to the low impedance code following relays.

In another aspect of the invention, the timing circuit comprises a timer integrated circuit operating in an astable oscillator mode. Preferably, the timer integrated circuit receives an isolated DC power from a dedicated power source.

Yet another aspect of the present invention relates to an electronic code transmitter for driving a number of code following relays of a railroad signaling system. The electronic code transmitter comprises a timing circuit, a driving circuit, and an impedance balancing circuit. The timing circuit generates, at a predetermined code rate, square wave pulses with an approximate 50/50 duty cycle; and feeds the square wave pulses into the driving circuit. The driving circuit, upon receiving the square wave pulses, conducts, at the predetermined code rate, a power source to the code following relays. The Impedance balancing circuit is coupled to an output of the driving circuit to eliminate electrical noise associated with high impedance loads. Thereby, the electronic code transmitter is capable of driving code following relays of any load impedance.

In another aspect of the invention, the timing circuit comprises a timer integrated circuit operating in an astable oscillator mode. Preferably, the timer integrated circuit receives an isolated DC power from a dedicated power source.

In yet another aspect of the invention, the impedance balancing circuit maintains an adequate output load impedance for the electronic code transmitter. Preferably, the impedance balancing circuit comprises a resistor coupled in parallel with the code following relays.

A further aspect of the present invention relates to an electronic code transmitter for driving a number of code following relays of a railroad signaling system. The electronic code transmitter comprises a timer integrated circuit, a frequency regulator circuit, and a controlling relay. The timer integrated circuit generates, at a predetermined code rate, coded pulses with a predetermined duty cycle; and feeds the coded pulses into the controlling relay. The controlling relay, upon receiving the coded pulses, conducts, at the predetermined code rate, a power source to the code following relays. The frequency regulator circuit, which is coupled to the timer integrated circuit, regulates the predetermined code rate by varying a value of at least one of its components, yet maintaining the predetermined duty cycle.

In another aspect of the invention, the timer integrated circuit is a '555 type timer configured to operate in an astable oscillator mode. Preferably, the timer integrated circuit receives an isolated DC power from a DC-DC converter.

In yet another aspect of the invention, the electronic code transmitter further comprises a resistor, coupled in parallel with the code following relays, to maintain an adequate output load impedance for the electronic code transmitter.

The above and still other further objects, features and advantages of the present invention will become more apparent upon consideration of the following detailed description of several specific embodiments thereof, especially when taken in conjunction with the accompanying drawings.

DETAILED DESCRIPTION OF PREFERRED EMBODIMENTS

Figure 1:
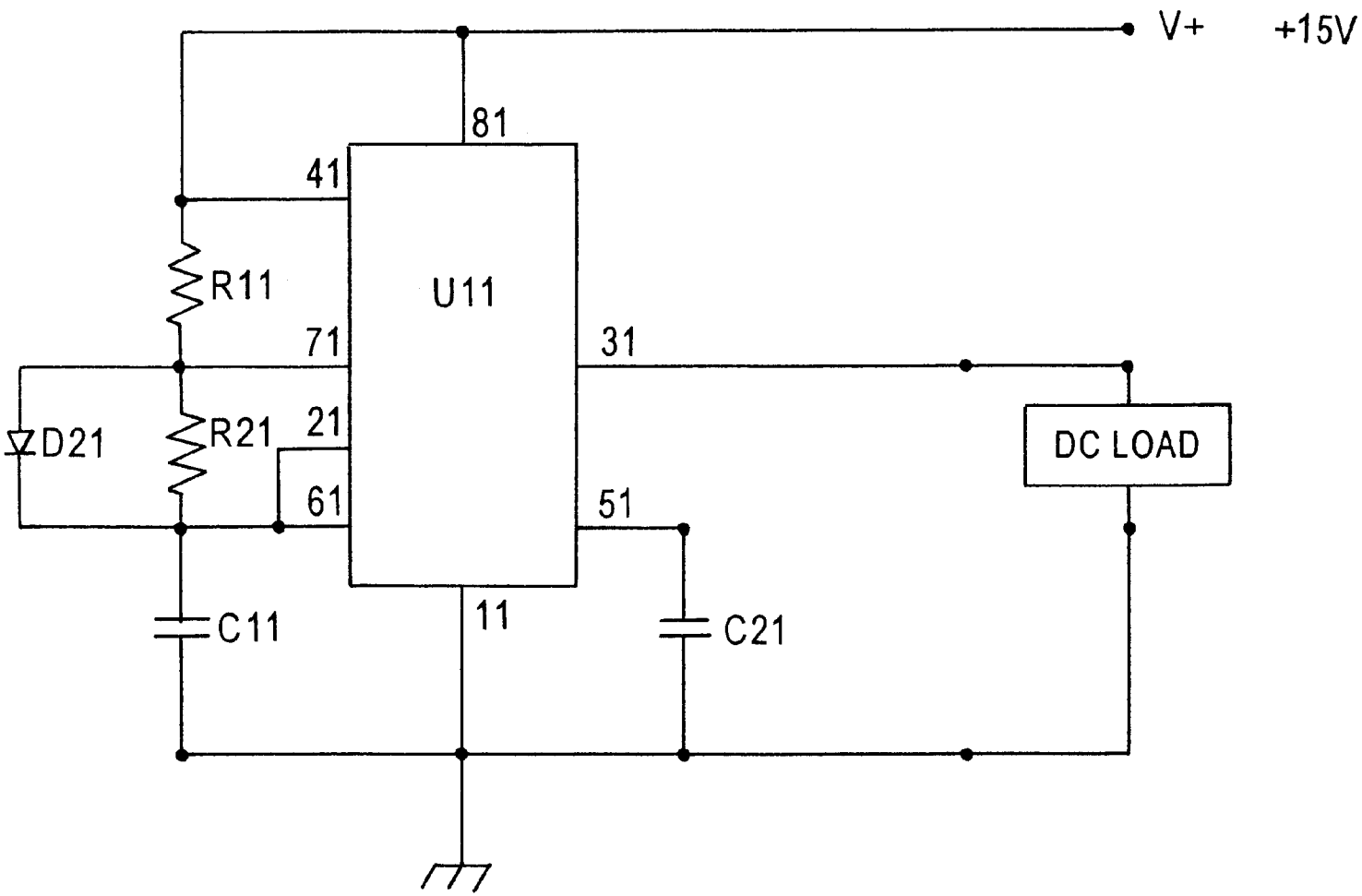
FIG. 1 (PRIOR ART)
FIG. 1 is a schematic diagram of a basic astable circuit built with a timer IC.

Shown in FIG. 1 is a basic astable circuit built with timer IC. This astable circuit comprises a '555 type timer U11, resistors R11 and R21, capacitors C11 and C21, and a diode D21. As depicted in FIG. 1, pins 41 and 81 of the '555 type timer IC U11 and a first end of the resistor R11 are coupled to a positive direct current voltage V+ of 15 VDC. A pin 71 of the '555 type timer IC U11 is coupled to an anode of the diode D21, a second end of the resistor R11 and a first end of the resistor R21. Pins 21 and 61 of the '555 type timer IC U11 are coupled to a cathode of the diode D21 and a second end of the resistor R21. A pin 11 of the '555 type timer IC U11 is grounded. The capacitor C21 is placed between pin 51 and ground. A pin 31 is an output of the '555 type timer IC U11. In operation, a DC load is connected across the output 31 and ground.

This conventional circuit so configured functions as an astable or free running oscillator. The term "free running" refers to the fact that the only requirement for this circuit to output continuous square wave pulses is the application of the DC voltage V+. Upon receiving the DC voltage V+, the '555 type timer IC U11 keeps switching the capacitor C11 between charging and discharging states. When the capacitor C11 is charged through the resistor R11 and the diode D21, an on-time of square wave pulses is formed at the output 31. When the capacitor C11 is discharged through the resistor R21, an off-time of the square wave pulses is formed. By selecting appropriate values for the resistors R11 and R21 and the capacitor C11, the astable circuit is capable of producing output coded pulses with near 50% on-time percentage.

However, this circuit is preferably recommended only for circuits with a supply voltage of 15 VDC due to the presence of the diode D21. It is considered less reliable with supply voltages under 15 VDC, and not completely stable due to the temperature effect of the forward voltage of the diode D21. Thus, this circuit is preferably not to be used in railroad signaling systems where the code generators are exposed to severe environmental conditions, and where the supply voltage may vary very strongly, as much as from 8 to 15 VDC.

The present invention solves this and other problems by providing a timer IC based electronic code transmitter which is reliable and dependable over a wide range of ambient temperatures, humidity, and supply voltage.

Figure 2A:
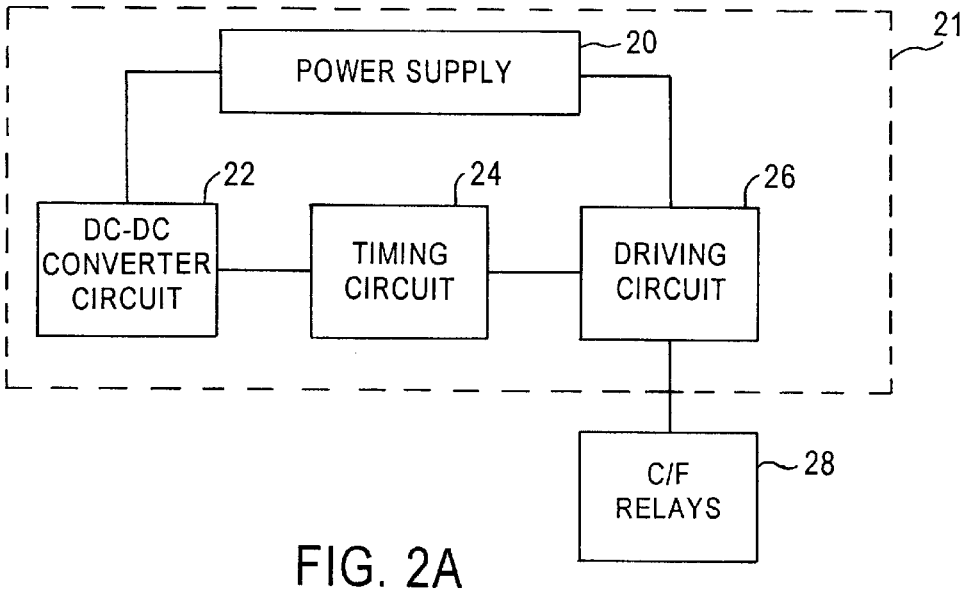
FIGS. 2A and 2B are functional block diagrams of electronic code transmitters in accordance with preferred embodiments of the invention.

FIG. 2A shows a functional block diagram of an electronic code transmitter 21 in accordance with one embodiment of the present invention. The circuit comprises a dedicated power source 22, a timing circuit 24, and a driving circuit 26.

The dedicated power source 22 receives a DC current from a power supply 20 or another source, and provides the timing circuit 24 with a regulated and isolated DC voltage. The timing circuit 24 produces precise square wave pulses with a near 50/50 duty cycle at a code rate of 50, 75, 120, 180, 270, or any code rate utilized by the railroad signaling system in which the electronic code transmitter has been installed. These square wave pulses are then fed to the driving circuit 26 which operates in a relay-like mode. The driving circuit 26 conducts currents from the power supply 20 to code following relays 28 at the code rate dictated by the timing circuit 24. Although it is depicted in FIG. 2A that the dedicated power source 22 and the driving circuit 26 are connected to the same power source of the power supply 20, other arrangements can be readily contemplated by one of skill in the art.

Figure 3:
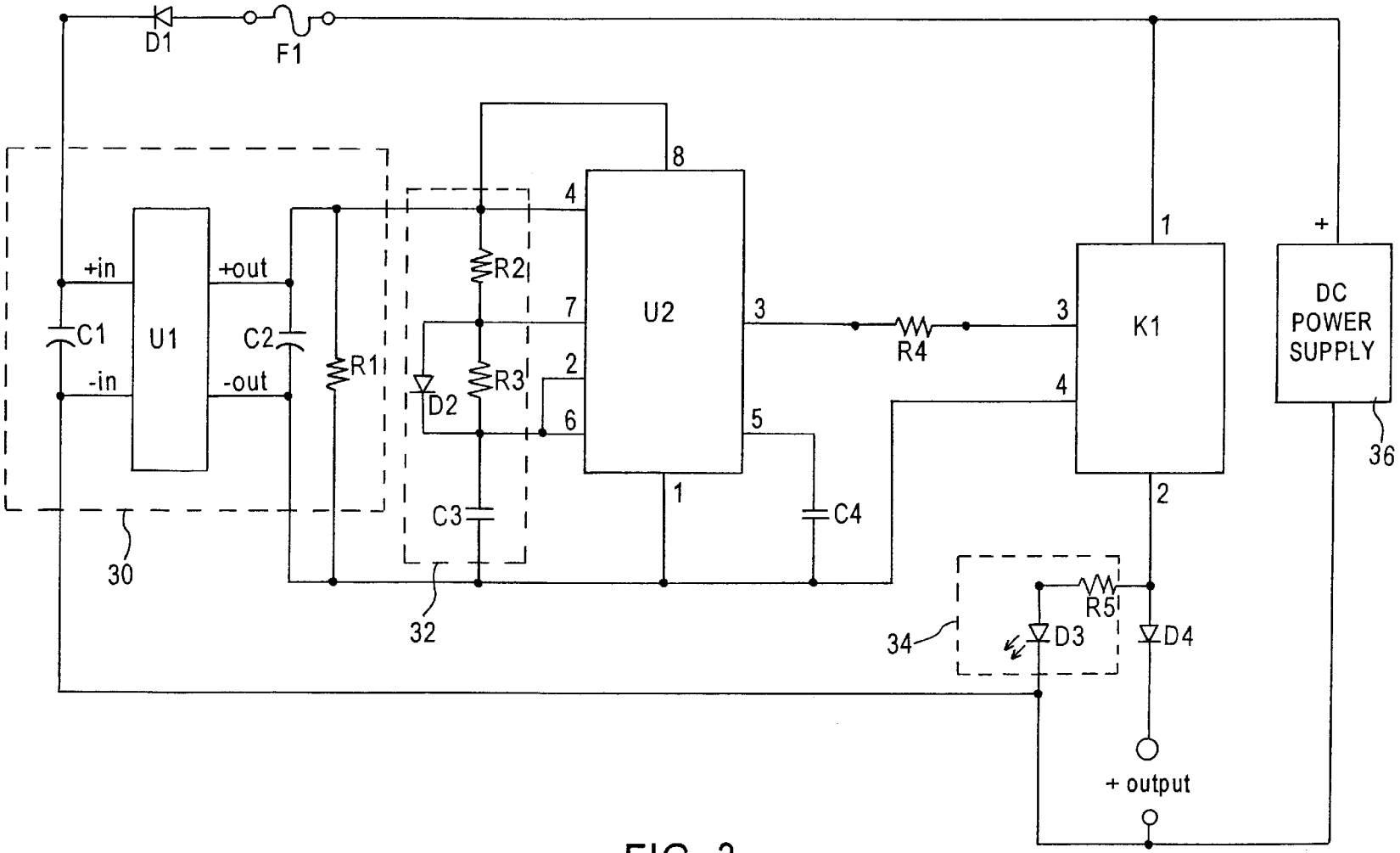
FIGS. 3 and 3A are alternative circuit diagrams of the electronic code transmitter shown in FIG. 2A.

The electronic code transmitter shown in FIG. 2A can be implemented by a timer IC based circuit, which is illustrated in FIG. 3. The timer IC based circuit, among other things, comprises a converter circuit 30, a frequency regulator circuit 32, a timer IC U2, a relay K1, and an indicator circuit 34.

The converter circuit 30 includes a DC-DC converter U1 with capacitors C1 and C2 placed across its input and output, respectively. The converter circuit 30 also includes a resistor R1 which is placed across the output of the DC-DC converter U1. Preferably, the DC-DC converter U1 is an isolated wide input voltage device which is capable of providing the timer IC U2 with a stable, regulated and isolated DC voltage.

It has been found that the timing circuit based on the timer IC U2 can produce coded pulses with a correct code rate and duty cycle even if it is connected directly to the same DC power source 36 which supplies the code following relays. However, the code following relays, in some situations, would "sound" and act as though there was insufficient drive current. The problem can be solved by providing the timer IC U2's circuit with a separate power supply, such as dedicated power source 22 of FIG. 2A when it receives currents from sources other than the power supply 20. The use of the DC-DC converter U1 is preferable because this allows the electronic code transmitter of the invention to be a direct replacement for the existing mechanical code generators, without the need of installing a supplementary power supply.

The DC-DC converter U1's parameters, therefore, will be determined by the type of the timer IC U2 selected. Likewise, the resistor R1 and capacitors C1 and C2 are correspondingly chosen so as to meet the minimum load requirement, and to ensure the full parametric performance over the full line and load range of the DC-DC converter U1.

In one embodiment, the converter circuit 30 is connected to the DC power source 36 through a serial connection of a fuse F1 and a diode D1. The fuse F1 operates as a level of relay protection for the whole circuit, and must have a sufficient DC current rating to allow for the high in-rush current that the DC-DC converter U1 is subjected to upon start up. Preferably, the fuse F1 is a fast acting, automatic resetting type. The diode D1 has an anode connected to a positive terminal of the DC power source 36, and a cathode connected to an electrode of the capacitor C1 which is coupled to a positive input of the DC-DC converter U1. The inclusion of the diode D1 is to provide a reversed polarity protection device that also isolates the capacitor C1 from the DC power source 36. Preferably, the diode D1 is a silicon diode.

The frequency regulator circuit 32 comprises a serial connection of resistors R2 and R3 and a capacitor C3. A diode D2, connected in parallel with the discharging resistor R3, has a cathode coupled to an electrode of the capacitor C3 and an anode coupled to one end of the charging resistor R2. The other electrode of the capacitor C3 is connected to a negative output of the DC-DC converter U1. The other end of the charging resistor R2 is connected to a positive output of the DC-DC converter U1. Preferably, the diode D2 is of an ultra fast type.

In one embodiment, the timer IC U2 is of a '555 type timer, the characteristics of which are well known in the art, and need not be recited herein. Any device and combination of devices having similar characteristics can be substituted. As shown in FIG. 3, the '555 type timer IC U2 has pins 4 and 8 coupled to the positive output of the DC-DC converter U1, a pin 7 coupled to the anode of the diode D2, pins 2 and 6 coupled to the cathode of the diode D2, pins 1 and 5 coupled to the negative output of the DC-DC converter U1, and an output pin 3. A capacitor C4 is placed between pin 5 and the negative output of the DC-DC converter U1 to bypass the unused control voltage pin 5 for electrical noise immunity. The above arrangement is for exemplary purposes only, and should not be construed in a limiting sense. One of skill in the art can readily contemplate appropriate circuit arrangements if other device(s) is (are) used instead of the '555 type timer IC U2. Since the electronic code transmitter is built for the harsh environment encountered on the railroad, its components, especially the timer IC U2, are preferably of types rated for military use.

The relay K1 is preferably a solid state relay which, as shown in FIG. 3, has a pin 1 coupled to the positive terminal of the DC power source 36, a pin 3 coupled to the output pin 3 of the timer IC U2, a pin 4 coupled to the negative output of the DC-DC converter U1, and a pin 2 coupled to an anode of an output diode D4. A cathode of the output diode D4 is connected to a number of electromechanical code following relays. The output diode D4 protects the solid state relay K1 from electromagnetic frequency noise spikes generated by the electromechanical code following relays that operate from the same the DC power source 36.

Figure 3A:
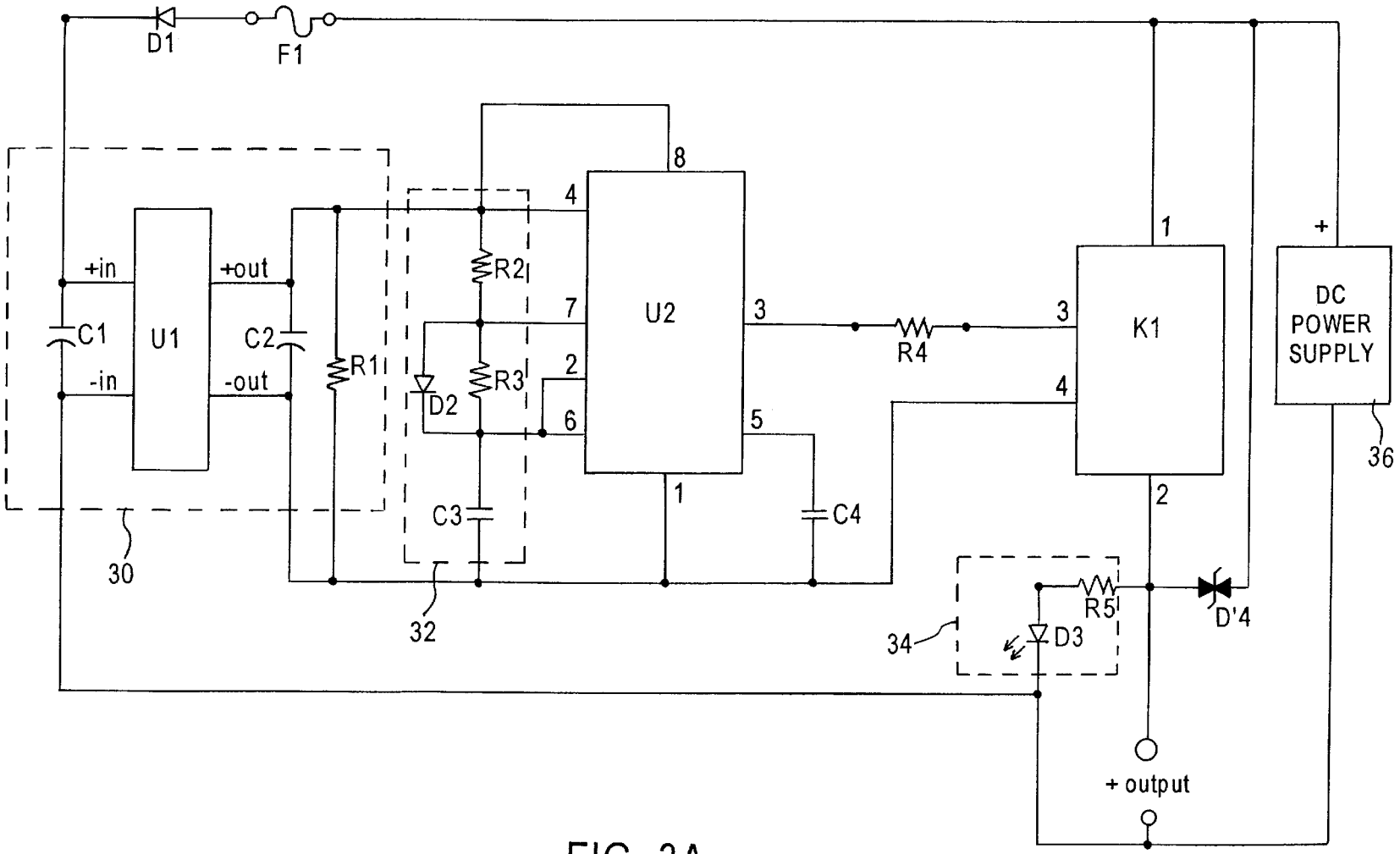

In another implementation depicted in FIG. 3A, pin 2 of the relay K1 is coupled to an anode of a TVS (transient voltage suppressor) diode D4'. The remaining anode of the TVS diode D4' is connected to a positive terminal of DC power source 36. Generally, the TVS diode D4' protects the solid state relay K1 from electromagnetic frequency noise spikes more effectively than the diode D4.

Preferably, a limiting resistor R4 is placed between the output pin 3 of the timer IC U2 and pin 3 of the relay K1 to ensure a maximum input voltage to the relay K1.

In accordance with the present invention, the solid state relay K1 is capable of driving up to 60 electromechanical code following relays, depending on the following factors

- ambient operating temperatures
- temperature based de-rating curves for the solid state relay K1
- voltage of the DC power source 36
- the coil impedance of the electromechanical code following relays
- the forward DC current rating of the output diode D4 or the breakdown voltage and current rating of the TVS diode D4'.

For example, if the forward DC current rating of the output diode D4 is three amperes, then eighteen (18) electromechanical code following relays with 80 Ohm impedance coils can be driven by the electronic code transmitter shown in FIG. 3 at 13.2 VDC at an ambient temperature of 50° C. (122° F.). Under the same conditions of driving voltage and ambient temperature, twenty four (24) electromechanical code following relays can be driven by the electronic code transmitter shown in FIG. 3A when the TVS diode D4' breakdown voltage and current rating are set at 56.7 volts and 181 amperes, respectively.

The indicator circuit 34 includes a resistor R5 and a LED D3. The LED D3 has a cathode grounded and an anode coupled to one end of the resistor R5. The other end of the resistor R5 is connected to the anode of the output diode D4 or one anode of the TVS diode D4'. Though indicators of any kind, such as incandescent or neon lamps, can be used in the indicator circuit 34, light emitting diodes (LED) are preferable due to their long life span and reduced power consumption. The resistor R5 serves as a voltage drop resistor to allow the LED D3 to operate within its normal voltage range. The resistor R5 should also ensure proper heat dissipation of the indicator circuit 34, especially during the hot summer months. Placing the indicator circuit 34 at the output of the relay K1 makes it possible to show the output status of the whole electronic code transmitter.

Figure 4:
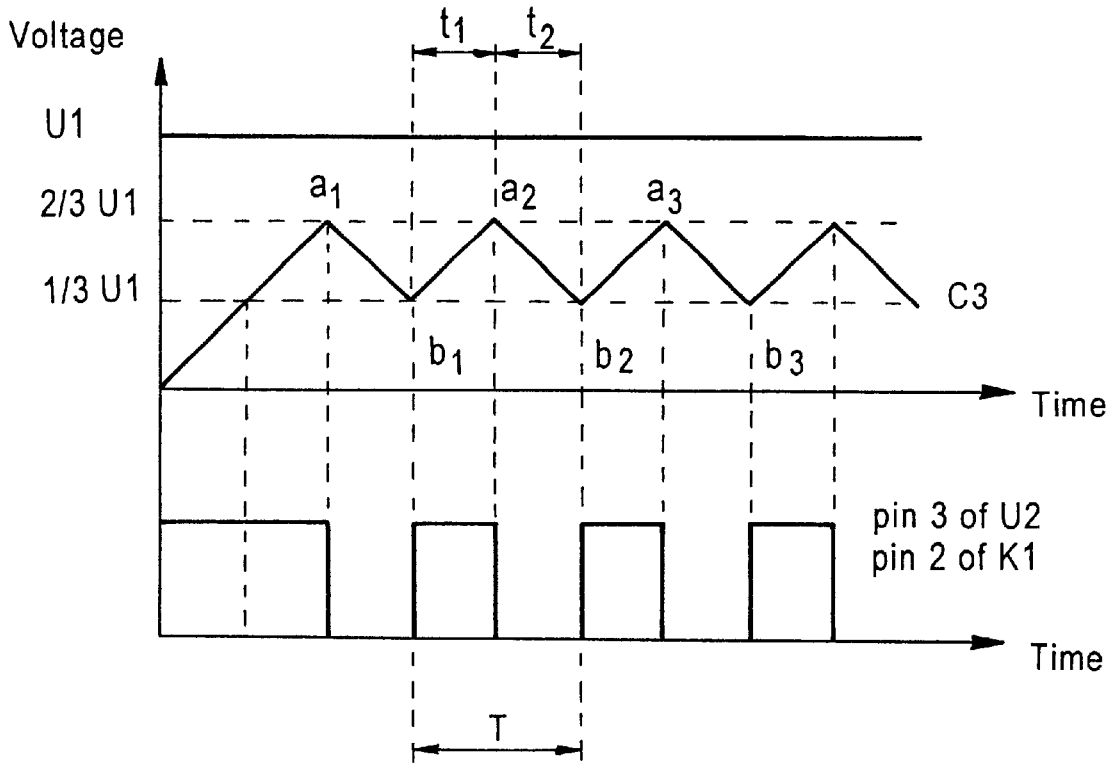
FIG. 4 is a timing chart illustrating the operation of the electronic code transmitter of the invention.

The operation of the electronic code transmitter shown in FIG. 3 is described as below with reference to the timing chart shown in FIG. 4.

When a DC voltage $V_{DC}$ is applied, at o, from the output of the DC-DC converter U1 to the frequency regulator circuit 32, the capacitor C3 is charged through the charging resistor R2 and the diode D2 in series. By shunting the discharging resistor R3 with diode D2, the discharging resistor R3 is effectively removed from the circuit during the charging cycle of the capacitor C3.

When the voltage of the capacitor C3 reaches ⅔ of the voltage $V_{DC}$, at $a_1$, $a_2$ or $a_3$, an internal upper comparator of the timer IC U2 triggers its internal flip-flop circuitry causing the capacitor C3 to discharge towards the negative output of the DC-DC converter U1 through the discharging resistor R3. During the discharging cycle of the capacitor C3, the diode D2 is reversed biased ensuring the discharging of the capacitor C3 is through the discharging resistor R3. When the voltage of the capacitor C3 reaches ⅓ of the voltage $V_{DC}$, at $b_1$, $b_2$ or $b_3$, an internal lower comparator of the timer IC U2 triggers its internal flip-flop circuitry causing the capacitor C3 to be charged through the charging resistor R2 and the diode D2. A new cycle is started again. Thus, the timer IC U2 is configured to operate in the astable oscillator mode, as discussed above.

The timer IC U2 generates at the output pin 3 a sequence of square wave pulses in accordance with the status of the capacitor C3. Particularly, the output pin 3 is at a HIGH level when the capacitor C3 is being charged, and at a LOW level when the capacitor C3 is being discharged. The time period while the output pin 3 is at the HIGH level is on-time period $t_1$, and is determined by, among other things, capacity of the capacitor C3 and resistance of the charging resistor R2. The time period while the output pin 3 is at the LOW level is off-time period $t_2$, and is determined by, among other things, capacity of the capacitor C3 and resistance of the discharging resistor R3.

Preferably, small capacity capacitors and high resistance resistors are chosen for the components of the frequency regulator circuit 32. With the high resistor values, it is unlikely for any changes in the resistor R2 and R3 over time to cause the electronic code transmitter output unintended code rate. The small capacity capacitors are commercially available at low cost and yet feature a wide operating temperature range. In an embodiment, a capacitor of 1.0 $\mu$F and resistors of 222.2 K and 238.79 K are used in the frequency regulator circuit of a 180 code rate electronic code transmitter.

The other factors that might affect the length of $t_1$ and/or $t_2$ include, but not limited to, the code rate utilized by the railroad signaling system, the capacitance of the DC-DC converter U1' output, and the selected type of the diode D2. In an embodiment, for the code rate of 180 and 270 beats/minute, the approximate mathematical formulas for determining $t_1$ and $t_2$ are shown below, respectively:

$$t_1=0.7425*R2*C3, \text{ and}$$

$$t_2=0.6707*R3*C3$$

The total time T is a sum of the on-time period $t_1$ and the off-time period $t_2$, and is determined as $$T=t_1+t_2=60 \text{ seconds/code rate}$$

By simply varying the values of R2, R3 or C3, the electronic code transmitter can be readily adapted to any code rate utilized by the railroad signaling system. Furthermore, the requirement of 50/50 duty cycle is met by simply varying the values of R2 and R3 so that the on-time period $t_1$ is equal or approximate to the off-time period $t_2$. Therefore, by regulating the values of the charging resistor R2, the discharging resistor R3 and/or the capacitor C3, the electronic code transmitter of the present invention is capable of producing a sequence of square wave pulses with near 50/50 duty cycle at any code rate.

In one embodiment, when the on-time period $t_1$ and the off-time period $t_2$ are matched, each of the five code rates currently in use by Amtrack's Cab Code Signaling system is accurately replicated with duty cycles of 49% and 50%.

In another embodiment, the code rates are replicated within tolerance and acceptable duty cycles of 50.5% and 51% if R2 is kept equal to R3. This embodiment has additional advantages of easy inventory control, reduced purchasing expenses, and minimized chances for production assembly errors.

As stated above, the sequence of square wave pulses generated by the timer IC U2 at the output pin 3 is fed, optionally, through the limiting resistor R4, into the relay K1 at pin 3. In an embodiment, when the voltage of pin 3 of the relay K1 is at the HIGH level, the relay K1 conducts currents from the DC power source 36 to the code following relays. The voltage of pin 2 of the relay K1 is then at a HIGH level. When the voltage of pin 3 of the relay K1 is at the LOW level, the relay K1 isolates the DC power source 36 from the code following relays. The voltage of pin 2 of the relay K1 is then at a LOW level. Thus, the sequence of square wave pulses generated at the output pin 3 of the timer IC U2 is exactly repeated at pin 2 of the relay K1, as shown in FIG. 4. The code following relays are accordingly driven at the code rate dictated by the timer IC U2.

Similarly, if another type of the relay K1 is alternatively used, the relay K1 conducts the currents when pin 3 of the relay K1 is at the LOW level, and cut the currents off when pin 3 of the relay K1 is at the HIGH level. This arrangement allows the code following relays to be driven at the predetermined code rate as well.

Under actual working conditions, the electronic code transmitter of the present invention might be subject to sufficiently high impedance loads, such as solid state code following relays, opto-coupled devices or a mixing thereof with low impedance electromechanical code following relays. These high input impedance devices present themselves as an almost invisible load to the electronic code transmitter. In this situation, the output of the electronic code transmitter contains electrical noises which distort the waveform of the square wave pulses. The distorted pulses might become unrecognizable and might be rejected by the train onboard detection system. Moreover, recent developments in cab signal systems, such as those for use in MARC or ACELA, require cleaner and more accurate coded pulses than the current cab signal system, such as the one used in AEM7 units.

A modified embodiment of the present invention is introduced to solve the problem. A functional block diagram of an electronic code transmitter 23 in accordance with this embodiment is presented in FIG. 2B.

Figure 2B:
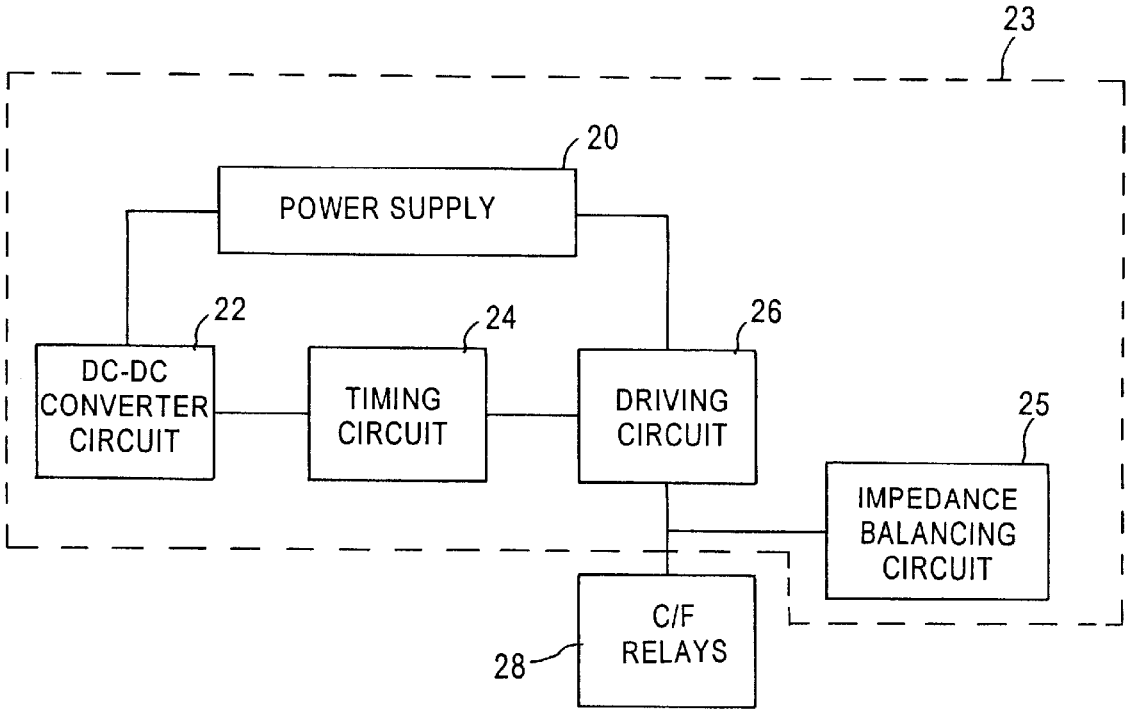

The circuit in FIG. 2B is similar to the circuit in FIG. 2A, with the identical components being designated by the same reference numbers. Therefore, it is not necessary to describe these components again. The electronic code transmitters 21 and 23 differ in that the circuit of FIG. 2B further comprises an impedance balancing circuit 25 which is connected to the output of the driving circuit 26 and the input of the code following relays 28. The impedance balancing circuit 25 eliminates the electrical noises associated with the high impedance loads, and thus, allows the electronic code transmitter of the present invention to work with code following relays of any load impedance.

Figure 5:
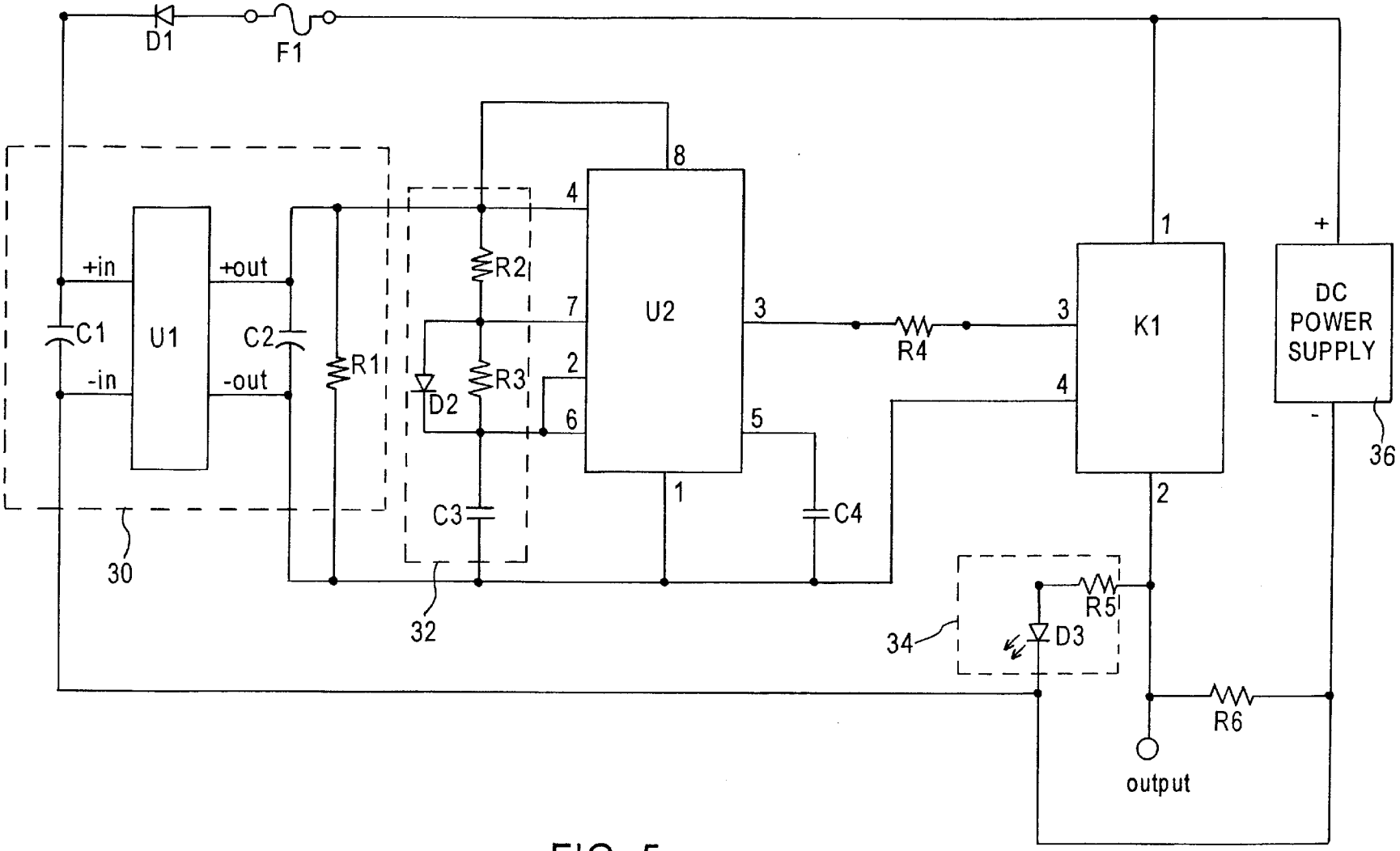
FIGS. 5 and 5A are alternative circuit diagrams of the electronic code transmitter shown in FIG. 2B.
Figure 5A:
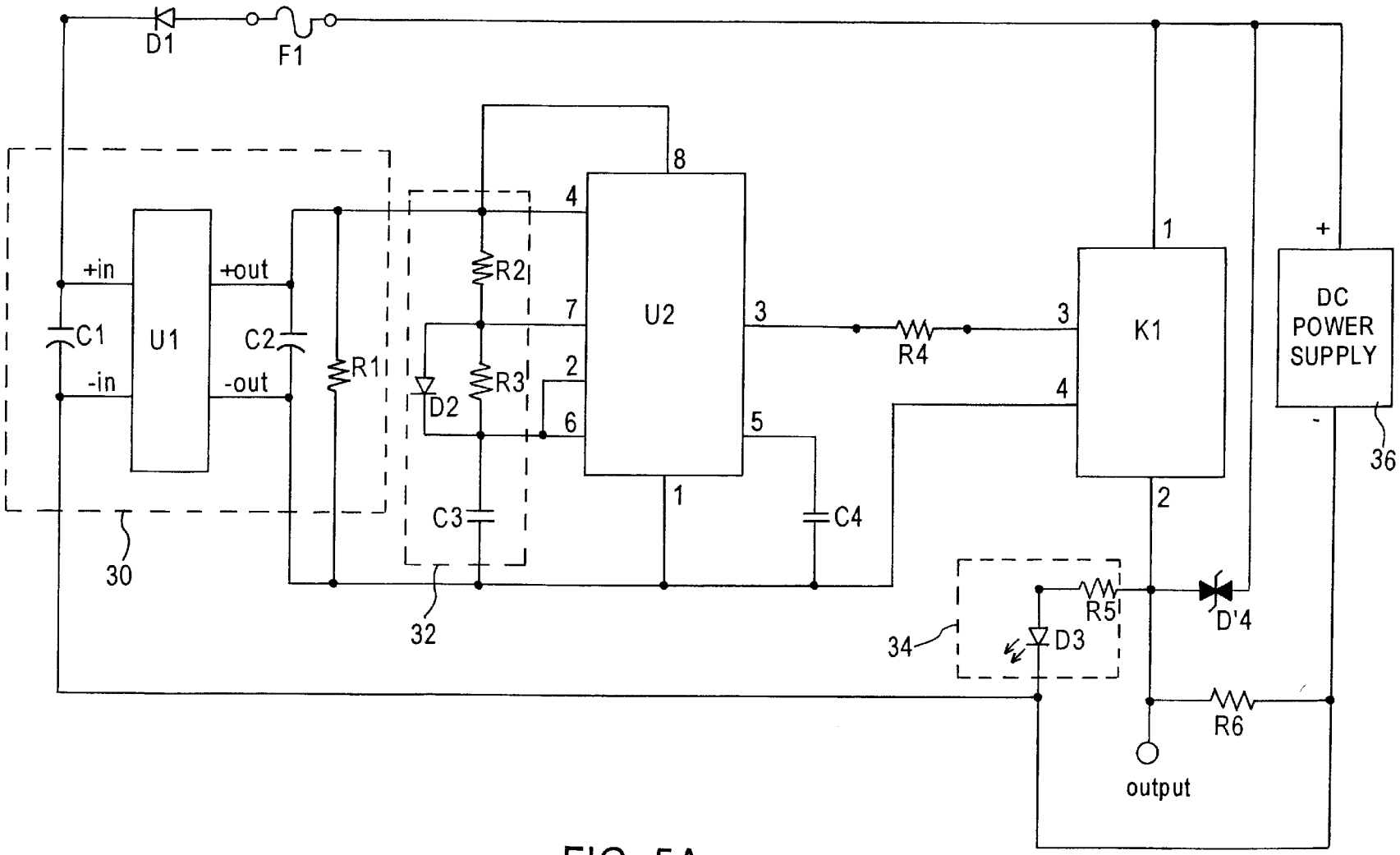

Preferred embodiments of the invention, utilizing a resistor as the impedance balancing circuit 25, are shown in FIGS. 5 and 5A. The electrical circuits in FIGS. 5 and 5A are similar to the electrical circuits in FIGS. 3 and 3A, respectively, with the identical components being designated by the same reference numbers. Therefore, it is not necessary to describe these components again. The electrical circuits of FIGS. 3 and 3A differ from the electrical circuits of FIGS. 5 and 5A in that the circuits of FIGS. 5 and 5A further comprises a resistor R6 which is connected either between the cathode of the output diode D4 and a negative terminal of the DC power source 36, as depicted in FIG. 5, or between an anode of the TVS diode D4' and the negative terminal of the DC power source 36, as depicted in FIG. 5A.

In effect, the resistor R6 is connected in parallel with the load including high input impedance devices such as solid state code following relays. The presence of the resistor R6 limits the output load impedance of the electronic code transmitter to a value not greater than a resistance of the resistor R6. Therefore, with an appropriate selected value of the resistor R6, the output load impedance can be maintained at an adequate level (not greater than the resistance of the resistor R6), the electrical noises usually accompanying high impedance loads will be eliminated, and the electronic code transmitter can drive code following relays regardless of the relays' input impedance.

It is understood that any device of other types, such as filters, can be used instead of the resistor R6. These devices serve well the objectives of the invention as long as they eliminate electrical noises associated with high impedance loads.

The electronic code transmitter in accordance with the present invention has many advantages. The inventive device can outperform comparable devices available on the market at up to $1/14^{th}$ the cost of a replacement unit, and at nearly $1/20^{th}$ the cost of a new unit.

Another significant advantage of the inventive device is fail safety. A failure test was conducted for scenarios where the components of the frequency regulator circuit 32 were shorted out or opened. The critical characteristics, i.e. code rate and duty cycle, of the output coded pulses are measured, and produced in the table below:

| TYPE OF FAILURE | CODE RATE | ON-TIME PERCENTAGE |
|---|---|---|
| D2 opens | Reduced from 180 to 120<br>Reduced from 120 to 75<br>Reduced from 75 to 50 | Increased from 50% to 66% |
| D2 shorts, C3, R2 or R3 shorts or opens | 0 | |

In every instance, the code rate decreased while the on-time percentage increased. This makes the electronic code transmitter virtually failsafe, because a less critical code rate or no code rate will be output instead of the intended one when one or more components of the circuit malfunctions.

The number of electromechanical code following relays, which can be simultaneously driven by a single electronic code transmitter, is also an advantage of the invention over other currently available types of electronic code generating circuit. As mentioned in the foregoing discussion, under certain circumstances, the electronic code transmitter of the invention is capable of driving up to 60 standard electromechanical code following relays. In contrast, other types of electronic code generating circuit can handle only about 2–4 electromechanical code following relays.

It will be obvious to those having ordinary skill in the art upon reading the foregoing specification that many changes may be made in the above-described embodiments of the present invention with out departing from the underlying principles thereof. Accordingly, it is intended that the protection granted hereon be limited only by the definition contained in the appended claims and equivalents thereof.

What is claimed is:

1. An electronic code transmitter for driving a plurality of low impedance code following relays of a railroad signaling system, the electronic code transmitter comprising:

a timing circuit for generating, at a predetermined code rate, square wave pulses with an approximate 50/50 duty cycle;

a driving circuit, coupled to the timing circuit, for receiving the square wave pulses and conducting, at the predetermined code rate, a power source to the plurality of low impedance code following relays; and a dedicated power source, coupled to the timing circuit, for providing an isolated DC power source to the timing circuit.

2. An electronic code transmitter for driving a plurality of low impedance code following relays of a railroad signaling system, the electronic code transmitter comprising:

a timing circuit for generating, at a predetermined code rate, square wave pulses with an approximate 50/50 duty cycle;

a driving circuit, coupled to the timing circuit, for receiving the square wave pulses and conducting, at the predetermined code rate, a power source to the plurality of low impedance code following relays, wherein the driving circuit includes a solid state relay; and a limiter, coupled between the timing circuit and the driving circuit, for maintaining a maximum input voltage to the solid state relay.

3. The electronic code transmitter of claim 2, further comprising an impedance balancing circuit, coupled to an output of the driving circuit, for eliminating electrical noises associated with high impedance loads, thereby allowing the electronic code transmitter to drive code following relays of any load impedance.

4. An electronic code transmitter for driving a plurality of low impedance code following relays of a railroad signaling system, the electronic code transmitter comprising:

a timing circuit for generating, at a predetermined code rate, square wave pulses with an approximate 50/50 duty cycle;

a driving circuit, coupled to the timing circuit, for receiving the square wave pulses and conducting, at the predetermined code rate, a power source to the plurality of low impedance code following relays; and an impedance balancing circuit, coupled to an output of the driving circuit, for eliminating electrical noises associated with high impedance loads, thereby allowing the electronic code transmitter to drive code following relays of any load impedance.

5. The electronic code transmitter of claim 4, wherein the timing circuit includes a timer integrated circuit operating in an astable oscillator mode.

6. The electronic code transmitter of claim 5, wherein the timer integrated circuit is of '555 type timer.

7. The electronic code transmitter of claim 4, further comprising a dedicated power source, coupled to the timing circuit, for providing an isolated DC power source to the timing circuit.

8. The electronic code transmitter of claim 4, further comprising an indicator circuit, coupled to an output of the driving circuit, for indicating an output status of the electronic code transmitter.

9. The electronic code transmitter of claim 4, wherein the driving circuit includes a solid state relay.

10. The electronic code transmitter of claim 4, wherein the impedance balancing circuit maintains an adequate output load impedance for the electronic code transmitter.

11. The electronic code transmitter of claim 10, wherein the impedance balancing circuit includes a resistor coupled in parallel with the plurality of code following relays.

12. An electronic code transmitter for driving a plurality of code following relays of a railroad signaling system, the electronic code transmitter comprising:

a timer integrated circuit for generating, at a predetermined code rate, coded pulses with a predetermined duty cycle;

a frequency regulator circuit, coupled to the timer integrated circuit, for regulating the predetermined code rate; and a controlling relay, coupled to the timer integrated circuit, for receiving the coded pulses and conducting, at the predetermined code rate, a power source to the plurality of code following relays.

13. The electronic code transmitter of claim 12, further comprising a DC-DC converter, coupled to the timer integrated circuit, for providing a regulated and isolated DC power source to the timer integrated circuit.

14. The electronic code transmitter of claim 12, wherein the timer integrated circuit is of '555 type timer.

15. The electronic code transmitter of claim 12, wherein the frequency regulator circuit includes a first resistor, a second resistor and a capacitor coupled in series, and a diode coupled in parallel with the second resistor.

16. The electronic code transmitter of claim 15, wherein the first resistor and the second resistor are of equal value.

17. The electronic code transmitter of claim 5, wherein the diode is of ultra fast type.

18. The electronic code transmitter of claim 15, wherein the predetermined code rate is regulated by varying a value of at least one of the first resistor, the second resistor, and the capacitor.

19. The electronic code transmitter of claim 12, further comprising a third resistor, coupled in parallel with the plurality of code following relays, for maintaining a necessary output load impedance, thereby allowing the electronic code transmitter to drive code following relays of any load impedance.

20. The electronic code transmitter of claim 12, wherein the timer integrated circuit is configured to operate as an astable oscillator, the coded pulses are square wave pulses generated at an output of said astable oscillator which is coupled to a signal input of said controlling relay, said controlling relay further comprises a power input adapted to be connected to said power source and a power output adapted to be connected to said code following relays, said power source is conducted from the power input to the power output of said controlling relay in accordance with the square wave pulses received at the signal input of said controlling relay.

21. The electronic code transmitter of claim 20, further comprising a limiting resistor, coupled between the output of said astable oscillator and the signal input of the controlling relay.

22. The electronic code transmitter of claim 20, wherein the timer integrated circuit is a '555 type timer a control input of which is grounded via a capacitor.

23. The electronic code transmitter of claim 20, further comprising a resistor coupled in parallel with the code following relays at the power output of said controlling relay.

24. An electronic code transmitter for driving a plurality of low impedance code following relays of a railroad signaling system, the electronic code transmitter comprising:

a timing circuit for generating, at a predetermined code rate, square wave pulses with an approximate 50/50 duty cycle; and a driving circuit, coupled to the timing circuit, for receiving the square wave pulses and conducting, at the predetermined code rate, a power source to the plurality of low impedance code following relays;

wherein the driving circuit includes a solid state relay and a transient voltage suppressor diode coupled between load terminals of the solid state relay.

25. The electronic code transmitter of claim 24, further comprising an impedance balancing circuit, coupled to an output of the driving circuit, for eliminating electrical noises associated with high impedance loads, thereby allowing the electronic code transmitter to drive code following relays of any load impedance.

26. An electronic code transmitter for driving a plurality of low impedance code following relays of a railroad signaling system, the electronic code transmitter comprising:

a timing circuit for generating, at a predetermined code rate, square wave pulses with an approximate 50/50 duty cycle; and a driving circuit, coupled to the timing circuit, for receiving the square wave pulses and conducting, at the predetermined code rate, a power source to the plurality of low impedance code following relays;

wherein the timing circuit includes a timer integrated circuit operating in an astable oscillator mode; and the square wave pulses are generated at an output of said astable oscillator which is coupled to a signal input of said driving circuit, said driving circuit further comprises a power input adapted to be connected to said power source and a power output adapted to be connected to said code following relays, said power source is conducted from the power input to the power output of said driving circuit in accordance with the square wave pulses received at the signal input of said driving circuit.

27. The electronic code transmitter of claim 26, wherein the driving circuit is a solid state relay, said electronic code transmitter further comprising a limiting resistor, coupled between the output of said astable oscillator and the signal input of the solid state relay.

28. The electronic code transmitter of claim 26, wherein the timer integrated circuit is a '555 type timer a control input of which is grounded via a capacitor.

29. The electronic code transmitter of claim 26, further comprising an impedance balancing circuit, coupled to an output of the driving circuit, for eliminating electrical noises associated with high impedance loads, thereby allowing the electronic code transmitter to drive code following relays of any load impedance.

30. The electronic code transmitter of claim 29, wherein the driving circuit is a solid state relay, said electronic code transmitter further comprising a limiting resistor, coupled between the output of said astable oscillator and the signal input of the solid state relay.

31. The electronic code transmitter of claim 29, the timer integrated circuit is a '555 type timer a control input of which is grounded via a capacitor.

32. The electronic code transmitter of claim 29, wherein the impedance balancing circuit includes a resistor coupled in parallel with the code following relays.

33. A railroad signaling system, comprising:

a DC power source;

an electronic code transmitter comprising a timer integrated circuit powered by said DC power source to generate, at a signal output of said timer integrated circuit and at a predetermined code rate, coded pulses with a predetermined duty cycle; and a controlling relay having a signal input coupled to the signal output of said timer integrated circuit, a power input connected to said DC power source and a power output, said controlling relay conducting, at the predetermined code rate, said DC power source from the power input to the power output in accordance with the coded pulses received from the timer integrated circuit; and a plurality of code following relays coupled to the power output of said controlling relay for inputting pulsed signals, at the predetermined code rate, onto rails when said DC power source is supplied hereto via said controlling relay.

34. The railroad signaling system of claim 33, wherein the timer integrated circuit is configured to operate as an astable oscillator.

35. The railroad signaling system of claim 34, wherein the timer integrated circuit is a '555 type timer a control input of which is grounded via a capacitor.

36. The railroad signaling system of claim 34, further comprising a limiting resistor, coupled between the signal output of said astable oscillator and the signal input of the controlling relay.

37. The railroad signaling system of claim 34, further comprising a resistor coupled in parallel with the code following relays at the power of said controlling relay.

38. The railroad signaling system of claim 34, further comprising a DC-DC converter, coupled between the DC power source and the timer integrated circuit, for providing regulated and isolated DC power to the timer integrated circuit.

39. The railroad signaling system of claim 38, further comprising a frequency regulator circuit coupled between the DC-DC converter and the timer integrated circuit for regulating the predetermined code rate.

40. The railroad signaling system of claim 34, further comprising a transient voltage suppressor diode coupled between the power input and outputs of the controlling relay.

41. The railroad signaling system of claim 34, wherein the code following relays are electro-mechanical relays.

* * * * *